United States Patent [19]

Nakamura et al.

[11] 4,449,430

[45] May 22, 1984

[54] PIPE GRIPPING TOOLS

[75] Inventors: Masahiko Nakamura; Takashi Yokoyama, both of Mie, Japan

[73] Assignee: MCC Corporation, Mie, Japan

[21] Appl. No.: 258,551

[22] Filed: Apr. 29, 1981

[30] Foreign Application Priority Data

Aug. 13, 1980 [JP] Japan ..... 55-111488

[51] Int. Cl.[3] ..... B25B 13/28

[52] U.S. Cl. ..... 81/98; 81/186

[58] Field of Search ..... 81/53 A, 97–99, 81/111, 186

[56] References Cited

U.S. PATENT DOCUMENTS 1,576,918 3/1926 Lidell ..... 81/99
2,243,272 5/1941 Cole ..... 81/99
2,291,620 8/1942 Grau ..... 81/186
3,280,671 10/1966 Woodling ..... 81/186

FOREIGN PATENT DOCUMENTS 433214 4/1948 Italy ..... 81/97

*Primary Examiner*—James G. Smith
*Attorney, Agent, or Firm*—Wenderoth, Lind & Ponack

[57] ABSTRACT

A pipe gripping tool includes a body, a fixed jaw secured to the body and having a bite face, a movable jaw povoted to the body in opposition to the fixed jaw and having a plurality of cooperating bite faces for gripping a pipe in cooperation with the bite face on the fixed jaw and a return spring anchored at one end to the movable jaw and at the other end to the body. The plurality of bite faces on the movable jaw are positioned at different distances from the bite face on the fixed jaw.

1 Claim, 4 Drawing Figures

PIPE GRIPPING TOOLS

BACKGROUND OF THE INVENTION

This invention relates to improvements in pipe gripping tools such as pipe wrenches, pipe vices and chucks.

There have been proposed and practically employed a variety of pipe gripping tools of the above type and in most of these conventional pipe gripping tools, it has been usually practiced that a body is integrally formed at the leading end thereof with a fixed jaw, and a movable jaw is mounted on the body for movement toward and away from the fixed jaw by the operation of an operation member to thereby grip a pipe therebetween and release the pipe therefrom. Thus, the conventional pipe gripping tool has the disadvantage that adjustment of the distance between the gripping faces of the fixed and movable jaws to accommodate pipes having different diameters requires troublesome manual effort. For example such pipe gripping tools are shown in U.S. Pat. No. 2,460,079 and U.S. Pat. No. 1,769,333. Therefore, consideration has been given to forming the body at the leading end thereof with a fixed jaw and having a movable jaw pivoted to the body in opposing relationship to the fixed jaw to grip a pipe therebetween and release the pipe therefrom so as to accomodate pipes having different diameters without any special operation. However, it has been found difficult to design a movable jaw having a bite face which can suitably grip such pipes in cooperation with the opposing bite face on a fixed jaw and thus, such a movable jaw has not yet been practically developed or employed. Therefore, it has been strongly desired to develop a pipe gripping tool which is adapted to suitably grip pipes having different diameters without requiring any special operation.

SUMMARY OF THE INVENTION

Therefore, the object of the present invention is to provide a pipe gripping tool which can meet the abovementioned desire.

According to the present invention, there has been provided a pipe gripping tool which comprises an elongated body, a fixed jaw having a bite face secured to the body in an intermediate position between the leading and rear ends of the body and, a movable jaw having a plurality of spaced bite faces pivoted to the body at the leading end of the body by means of a pivot pin. The bite faces on the movable jaw are positioned at different distances from the bite face on the fixed jaw for gripping pipes of different diameters in cooperation with the fixed jaw bite face A return spring is anchored at one end to the movable jaw and at the other end to the body for normally urging the movable jaw in a counterclockwise direction.

The above and other objects and attendant advantages of the present invention will be more readily apparent to those skilled in the art from a reading of the following detailed description in conjunction with the accompanying drawings which show one preferred embodiment of the present invention for illustration purposes only, but not for limiting the scope of the invention in any way.

DETAILED DESCRIPTION OF THE PREFERRED EMBODIMENTS

Figure 1:
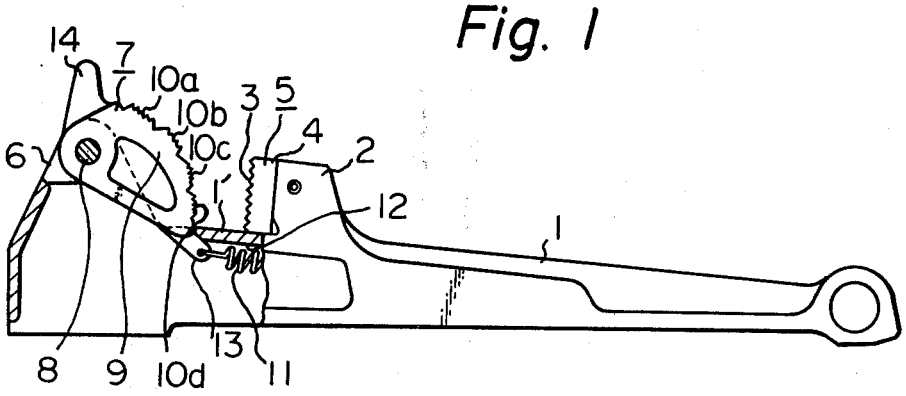
FIG. 1 is a side elevational view of one preferred embodiment of a foot vice constructed in accordance with the present invention with a portion thereof broken away.

The present invention now will be described referring to the accompanying drawings which show a foot vice as one preferred embodiment of the pipe gripping tool of the present invention for illustration purposes only.

The foot vice generally comprises an elongated body 1 which constitutes the base of the foot vice and is formed with an upwardly projecting rear or fixed jaw mount 2 in a position between the leading and rear ends of the body 1. A pawl 4 having a saw-toothed bite face 3 on the front thereof is secured to the front of the jaw mount 2 to provide a fixed jaw 5. A forward jaw mount 6 is formed at and projects upwardly from the leading end of the elongated body 1 forwardly spaced from the rear jaw mount 2 and a movable jaw 7 is pivoted to the forward jaw mount 6 by means of a pivot pin 8. The movable jaw 7 comprises a substantially sector-shaped body 9 on the outer edge portion of which are formed four equally spaced saw-toothed bite faces **10*a*, 10*b*, 10*c* and 10*d* which are positioned at different distances from the opposing saw-toothed bite face 3 on the fixed jaw 5**.

Figure 2:
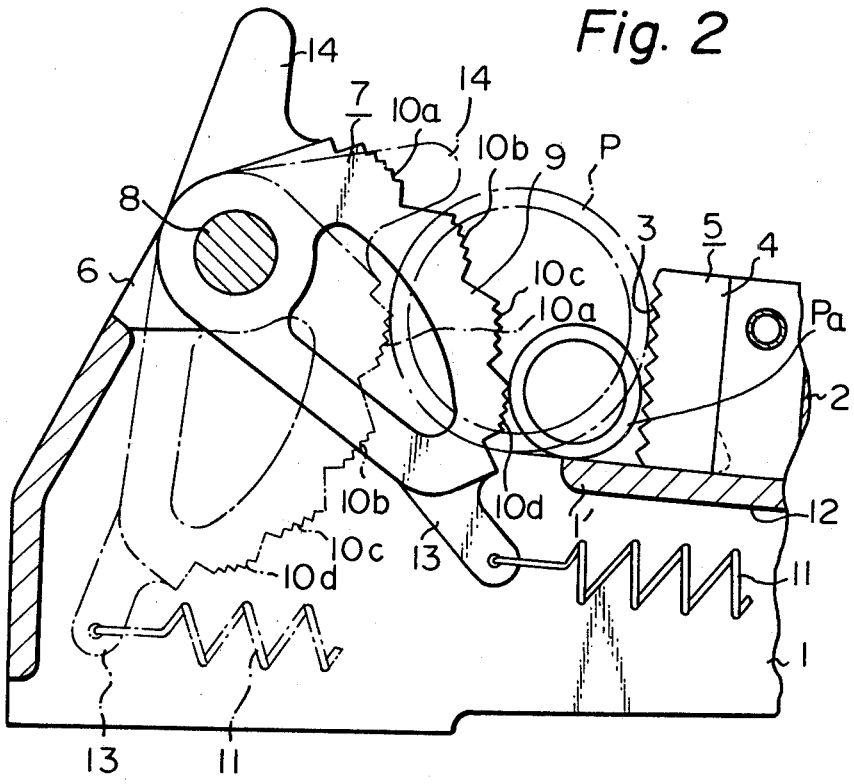
FIG. 2 is a fragmentary side elevational view, on an enlarged scale of the said foot vice as shown in FIG. 1.

In the illustrated embodiment, the top of each tooth in each of the saw-toothed bite faces **10*a*, 10*b*, 10*c* and 10*d* defines an angle of 80°, for example. In each of the bite faces 10*a*, 10*b*, 10*c* and 10*d*, the distance between the top or crest of the tooth on the lowermost side of the associated bite face (as seen in the drawing) and the center of the pivot pin 8 is maximum, and such distance decreases gradually towards the uppermost side of the same bite face (as seen in the drawing), with the distance between the top or crest of the tooth on the uppermost side of the same bite face (as seen in the drawing) and the center of the pivot pin being minimum. The distance between two teeth adjacent to each other of the movable jaw bite faces 10 decreases gradually from the uppermost bite fact to the lowermost bite face, as seen in the drawing. That is, the addendum distance or pitch between the teeth of the bite face 10*a* is maximum and the addendum distance or pitch between the teeth of the succeeding bite faces 10*b*, 10*c* and 10*d* decreases gradually, with the addendum distance between the teeth of the bite face 10*d* being minimum, so that the uppermost bite face 10*a* cooperates with the bite face 3 to grip a pipe having a maximum diameter and the successive bite faces 10*b*, 10*c* and 10*d* cooperate with the bite face 3 to grip pipes having gradually reduced diameters, with the lowermost bite face 10*d* gripping a pipe having a minimum diameter in cooperation with the bite face 3. In this manner, optimum biting and fastening force can be provided for pipes having different diameters. In FIG. 2, a maximum diameter pipe P is shown by phantom lines between the uppermost bite face 10*a* and the bite face 3 in the phantom line position of the movable jaw 7, while a minimum diameter pipe Pa is shown by solid lines between the lowermost bite face 10*d* and the bite face 3 in the solid line position of the movable jaw 7**.

A bracket 13 is secured to and extends downwardly from the lower or right-hand end of the movable jaw 7, and a return spring 11 is anchored at one end to the bracket 13 and at the other end to the body 1 so as to normally urge the movable jaw 7 in the counter-clockwise direction as seen in the drawing. The return spring 11 is positioned within an elongated recess 12 formed in the undersurface of the body 1 between the jaw mounts 2, 6. A manual operation handle 14 can be optionally provided on the top end of the movable jaw 7 extending uprightly from the jaw 7 so that the movable jaw can be manually operated as desired.

With the above-mentioned construction and arrangement of the components of the foot vice of the present invention, in operation, when a pipe P is forced into the space defined between the bite face 3 on the fixed jaw 5 on the top of the intermediate portion of the body 1 and the movable jaw 7 pivoted to the movable jaw mount 6 on the top of the leading end of the body 1 by means of the pivot pin 8, since the movable jaw 7 is normally urged in the counter-clockwise direction under the biassing force of the return spring 11, when the insertion force applied to the pipe P overcomes the biassing force as the pipe P is inserted into the above-mentioned space under increasing force, the movable jaw 7 pivots about the pivot pin in the clockwise direction as seen in the drawing. As the movable jaw 7 pivots in the clockwise direction, the distance between the outer edge portion of the movable jaw 7 and the bite face 3 increases and the pipe P is moved deeper and deeper into the space. When the pipe P is positioned in a predetermined position in the space, the force applied to the pipe P for inserting the pipe is released therefrom whereupon the pipe is automatically held in positioned under the biassing force provided by the return spring 11 without requiring any manual holding operatoin.

Furthermore, since the movable jaw 7 is formed with the plurality of spaced bite faces **10*a*, 10*b*, 10*c* and 10*d* which are positioned at different distances from the bite face 3, the pipe P interposed between the fixed jaw 5 and movable jaw 7 in partial contact with the bite face 3 on the fixed jaw 5 also comes into contact with a suitable one of the bite faces 10*a*, 10*b*, 10*c* and 10*d* on the movable jaw 7, depending upon the diameter of the pipe P and thus, the pipe P can be suitably and positively gripped between the fixed and movable jaws 5 and 7 regardless of the diameter of the pipe P. With the pipe P gripped between the fixed and movable jaws 5, 7, a socket (not shown) is screwed onto a threaded end of the pipe P. Thereafter, when the socket is turned in the clockwise direction by a wrench or the like, for example, even when clockwise turning force is applied to the pipe P, since the movable jaw 7 is normally biassed in the counter-clockwise direction under the force of the return spring 11 so as to reduce the distance between the two jaws, the biassing force applied to the movable jaw 7 functions as the initial biting force between the cooperating opposite bite faces and any suitable one of the bite faces 10*a*, 10*b*, 10*c* and 10*d* cooperates with the opposing bite face 3 in gripping or biting the pipe P depending upon the diameter of the pipe P. As the insertion force applied to the pipe P increases and accordingly, the movable jaw 7 continues to pivot in the clockwise direction, the biting force applied to the pipe P by the selected bite face 10*a*, 10*b*, 10*c* or 10*d* and the opposing bite face 3 increases until the undersurface of the pipe P abuts against a seat 1' on the body 1 whereupon the pipe P is suitably and positively held in position by being bitten by the selected bite face 10*a*, 10*b*, 10*c* or 10*d* on the movable jaw 7 and the opposing bite face 3 on the fixed jaw 5**, thus effectively preventing any damage to the pipe P from inadvertent rotation.

Figure 3:
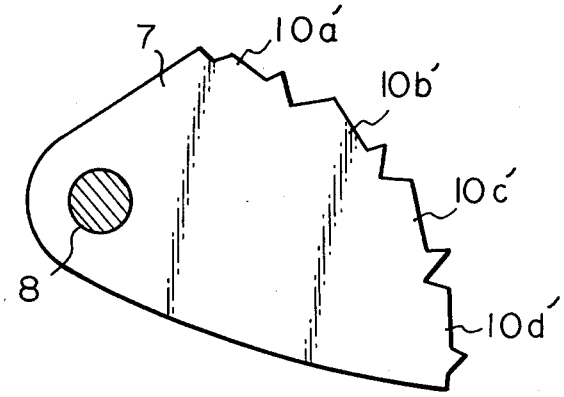
FIGS. 3 and 4 are elevational views of moveable jaws according to other embodiments of this invention.
Figure 4:
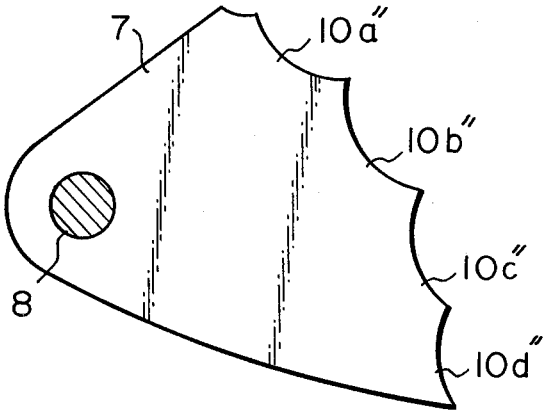

In the embodiment illustrated in FIGS. 1 and 2, although the bite face 3 on the stationary jaw 5 and the bite faces **10*a*, 10*b*, 10*c* and 10*d* are in the form of a sawtoothed bite faces, it is also within the scope of the present invention that the bite face 3 be formed with V-shaped grooves and the bite faces 10*a'*, 10*b'*, 10*c'* and 10*d'* be formed as flat faces each having angularly shaped projctions at one end thereof as shown in FIG. 3, or that the bite faces 10*a''*, 10*b''*, 10*c''* and 10*d''* be formed as arcuate faces in conformity with the contour of the periphery of the pipe P as shown in FIG. 4. The number of the bite faces on the movable jaw is not limited to four. The number of the bite faces on the movable jaw may vary from the illustrated four without departing from the scope of the present invention provided that the distances between the bite face 3 on the fixed jaw 5 and the opposing bite faces on the movable jaw 7 vary stepwise from one end to the other end of the movable jaw 7 to thereby attain the purpose contemplated by the present invention. When it is not required to hold the pipe P in position, for example, after the socket has been screwed onto the threaded end of the pipe P, the movable jaw 7 is pivoted in the clockwise direction against the biassing force of the return spring 11 so that the pipe P can be easily taken out of the space. According to the present invention, by the provision of the bite faces 10*a*, 10*b*, 10*c* and 10*d* on the movable jaw 7 at different distances from the opposing bite face 3 on the fixed jaw 5**, pipes having different diameters can be positively held in position by and released from the foot vice of the present invention with high efficiency without requiring any adjustment of the parts of the vice and the pipe P can be handled without being damaged. Although description has been made in connection with the invention as a foot vice, the invention can be equally applied to various pipe holding tools such as pipe wrenches, chain tongs and chucks.

As is clear from the foregoing description of the preferred embodiment of the present invention, according to the present invention, since the movable jaw is adapted to pivot in one direction against the force of the return spring by an insertion force applied to a pipe to be held in position and in the other or opposite direction under the biassing force of the return spring, and since the movable jaw is provided with a plurality of bite faces which are positioned stepwise at different distances from the opposing or cooperating bite face on the stationary jaw, pipes having different diameters can be positively and easily held in position by and released from the foot vice without any special troublesome operation. Thus, the present invention can effectively eliminate the disadvantages inherent in conventional pipe gripping tools and will contribute greatly to the art.

In the foregoing description has been made of one specific embodiment of the invention, but it will readily occur to those skilled in the art that the same is illustrative in nature, but does not limit the scope of the invention. The scope of the invention is only limited by the appended claims.

What is claimed is:

1. A foot operated pipe gripping tool for gripping pipes having different diameters, said tool comprising:

an elongated body having a base portion for supporting said body on a support surface, said body having forward and rear ends;

a fixed jaw extending upwardly from said body at a position intermediate between said forward and rear ends thereof, said fixed jaw having a bite face directed toward said forward end of said body;

a movable jaw pivoted to said forward end of said body by means of a pivot pin, said movable jaw having a plurality of distanct and separate bite faces spaced from each other along an edge of said movable jaw defined in a generally vertically extending plane and directed generally toward said bite face of said fixed jaw, said bite faces of said movable jaw being spaced at different distances from said bite face of said fixed jaw, thereby for gripping pipes of different diameter in cooperation with said bite face of said fixed jaw;

said fixed jaw and said movable jaw defining therebetween a generally upwardly directed space for the insertion in a generally downward direction of a pipe to be gripped;

return spring means, connected at a first end thereof to said movable jaw and at a second end thereof to said body, for urging said movable jaw to pivot about the axis of said pivot pin in a first generally upwardly direction toward said fixed jaw into a pipe gripping position;

projection means, extending generally upwardly from said movable jaw, for enabling manual operation for pivoting said movable jaw about said axis of said pivot pin in a second generally downward direction against the force of said spring means away from said fixed jaw to a pipe release position;

each said bite face of said movable jaw comprising a plurality of saw teeth constructed such that the distance between said axis of said pivot pin and the crest of each said tooth is a maximum at the lowermost said tooth, such distance decreases successively upwardly tooth-by-tooth, and such distance is a minimum at the uppermost said tooth; and said bite faces of said movable jaw being constructed such that the pitch between adjacent said teeth is a maximum at the uppermost said bite face, and the pitch between adjacent said teeth decreases successively downwardly bite face-by-bite face toward the lowermost said bite face.

* * * * *